US005879096A

United States Patent [19]

Franta et al.

[11] Patent Number: 5,879,096

[45] Date of Patent: Mar. 9, 1999

[54] GEL/CREAM APPLICATOR

[75] Inventors: Terrence Joseph Franta, Mount Holly; Rennold Lodge Klawson, Flemington, both of N.J.

[73] Assignee: Carter-Wallace, Inc., New York, N.Y.

[21] Appl. No.: 986,782

[22] Filed: Dec. 8, 1997

[51] Int. Cl.[6] ..... A45D 40/04

[52] U.S. Cl. ..... 401/175; 401/68; 401/75; 401/79; 222/390

[58] Field of Search ..... 401/68, 75, 79, 401/172, 175; 222/390

[56] References Cited

U.S. PATENT DOCUMENTS

| | | |
|---|---|---|
| Re. 34,751 | 10/1994 | Thompson . |
| 2,768,768 | 10/1956 | Cornell et al. . |
| 2,815,151 | 12/1957 | Collins . |
| 4,681,524 | 7/1987 | Ikeda et al. . |
| 4,923,096 | 5/1990 | Ennis, III . |
| 5,000,356 | 3/1991 | Johnson et al. . |
| 5,275,496 | 1/1994 | Fattori et al. . |
| 5,320,259 | 6/1994 | Weinstein . |
| 5,356,037 | 10/1994 | Harrold . |
| 5,372,285 | 12/1994 | Harrold et al. . |

FOREIGN PATENT DOCUMENTS 0 709 041 A1 10/1995 European Pat. Off. .

*Primary Examiner*—Henry J. Recla
*Assistant Examiner*—Tuan Nguyen
*Attorney, Agent, or Firm*—Watov & Kipnes, P.C.

[57] ABSTRACT

An applicator for cream-like or gel-like compounds having an elevator in a container that is advanced toward a dome applicator head at one end of the container by turning a helical ramp that engages ramp follows attached to the elevator, the ramp having valleys therein that allow pressure that is present in the compound after a portion has been dispensed through the apertures to force the elevator away from the dome so as to relieve the pressure and prevent the formation of liquid-phase separation products from weeping through the apertures.

10 Claims, 14 Drawing Sheets

| L-N | A° | B° | C | D |
|---|---|---|---|---|
| a | 90 | 90 | .010 | .012 |
| b | 75 | 105 | .013 | .012 |
| c | 120 | 60 | .018 | .012 |
| d | 95 | 85 | .013 | .017 |
| e | 100 | 80 | .014 | .016 |
| f | 105 | 75 | .015 | .015 |
| g | 90 | 90 | .017 | .013 |
| h | 80 | 100 | .016 | .014 |
| i | 75 | 105 | .012 | .018 |
| j | 85 | 95 | .015 | .020 |
| k | 90 | 90 | .019 | .021 |
| l | 85 | 95 | .018 | .022 |
| m | 105 | 75 | .024 | .016 |
| n | 95 | 85 | .022 | .018 |
| o | 60 | 120 | .016 | .024 |
| p | 75 | 105 | .015 | .025 |
| q | 90 | 90 | .020 | .015 |
| r | 75 | 105 | .016 | .024 |
| s | 80 | 100 | .018 | .022 |
| t | STARTER THREAD | | | |

FIG. 5C

GEL/CREAM APPLICATOR

FIELD OF THE INVENTION

The field of the present invention relates generally to dispensers, and particularly to dispensers for gel or cream-like products.

BACKGROUND OF THE INVENTION

Deodorants, pharmaceuticals and beauty aids in the form of cream or gel products are often applied by forcing them through apertures in the dome of a container with an elevator within the container that is advanced toward the dome by turning a knob or by some other manually operable mechanism.

One of the problems encountered is that continuous application of pressure by the elevator in the contained cream product, after a desired amount of gel or cream (such as an antiperspirant, for example) has been dispensed causes a liquid phase separation of the cream or any product that would separate into the liquid phase under compression, allowing the silicon portion of an antiperspirant, for example, to separate and flow through the apertures in the dome and down the sides of the container so as to get on the hands of a user as well as on the surface where the container is stored. This is generally referred to as weeping. This same problem may occur with certain gel products.

In some applicators designed to overcome this problem, a spring forces the elevator away from the dome of the container so as to relieve pressure on the cream after a desired amount of cream or gel has been dispensed. Examples of such applicators are described in U.S. Pat. Nos. 3,756,730 and 5,000,356, and in the European Patent No. 95307297.2.

BRIEF DESCRIPTION OF THE INVENTION

In one applicator of this invention, the elevator is attached to pins that ride on an helical ramp having valleys distributed along it. As the pins ride the up ramp side of a valley, the elevator is advanced so as to dispense cream or gel, but when the pins reach the down ramp side of the next valley along the ramp, the pressure in the cream or gel against the elevator forces the pins down the down ramp side of the valley so as to retract the elevator and relieve the pressure on the cream or gel that would otherwise cause weeping. It is important that the down ramp sides of the valleys be steep enough to permit the force exerted against the elevator by pressure in the cream or gel to overcome the force of friction between the periphery of the elevator and the inner wall of the container.

BRIEF DESCRIPTION OF THE DRAWINGS

Various embodiment of the present inventions are described with reference to drawings, in which like items are identified by the same reference designation, wherein:

FIG. 5C is a table illustrating details of a ramp that can be used in this invention;

DETAILED DESCRIPTION OF THE INVENTION

Figure 1A:
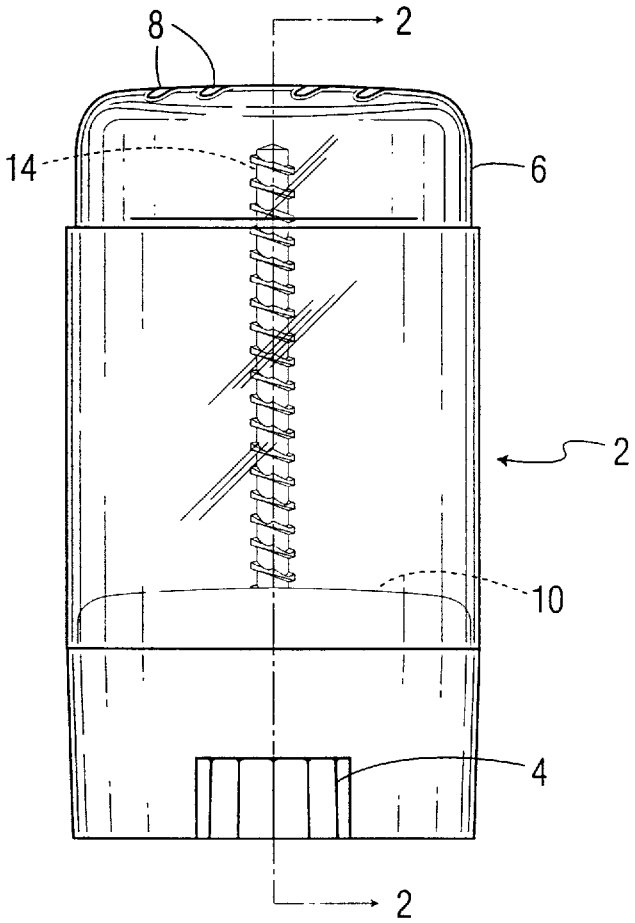
FIG. 1A is an external view of the container of the invention showing some of the internal components.
Figure 1B:
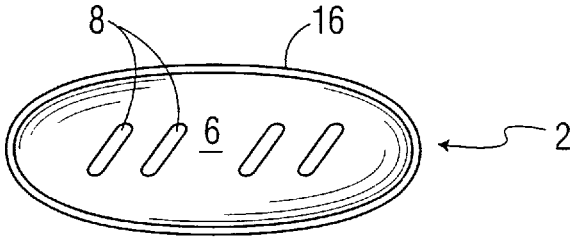
FIG. 1B is a top view of the container of FIG. 1A showing apertures in its dome through which cream or gel is extruded.

FIGS. 1A and 1B are exterior views of a container 2 having a knob 4 at one end, a dome 6 at the other, and apertures 8 in the dome 6. Although not usually visible from the outside, an elevator 10 that is driven toward the dome 6 by turning the knob 4 and a spindle 12 that supports an helical ramp 14 on which the elevator 10 rides are shown so as to give a general illustration of the overall operation of the applicator. Note that for purposes of illustration cream products are discussed, but gel products may also be applicable.

Although not shown, the cream to be applied is between the elevator 10 and the dome 6. When the elevator 10 is advanced toward the dome 6, the portions of the dome 6 between and around the apertures 8 produce considerable back pressure on the cream that if allowed to remain, would cause the cream to undergo a liquid phase separation and weep through the apertures 8. Note that for purpose of this illustration cream refers to any compound that can undergo liquid phase separation, where products of the compound separate under pressure.

Figure 2:
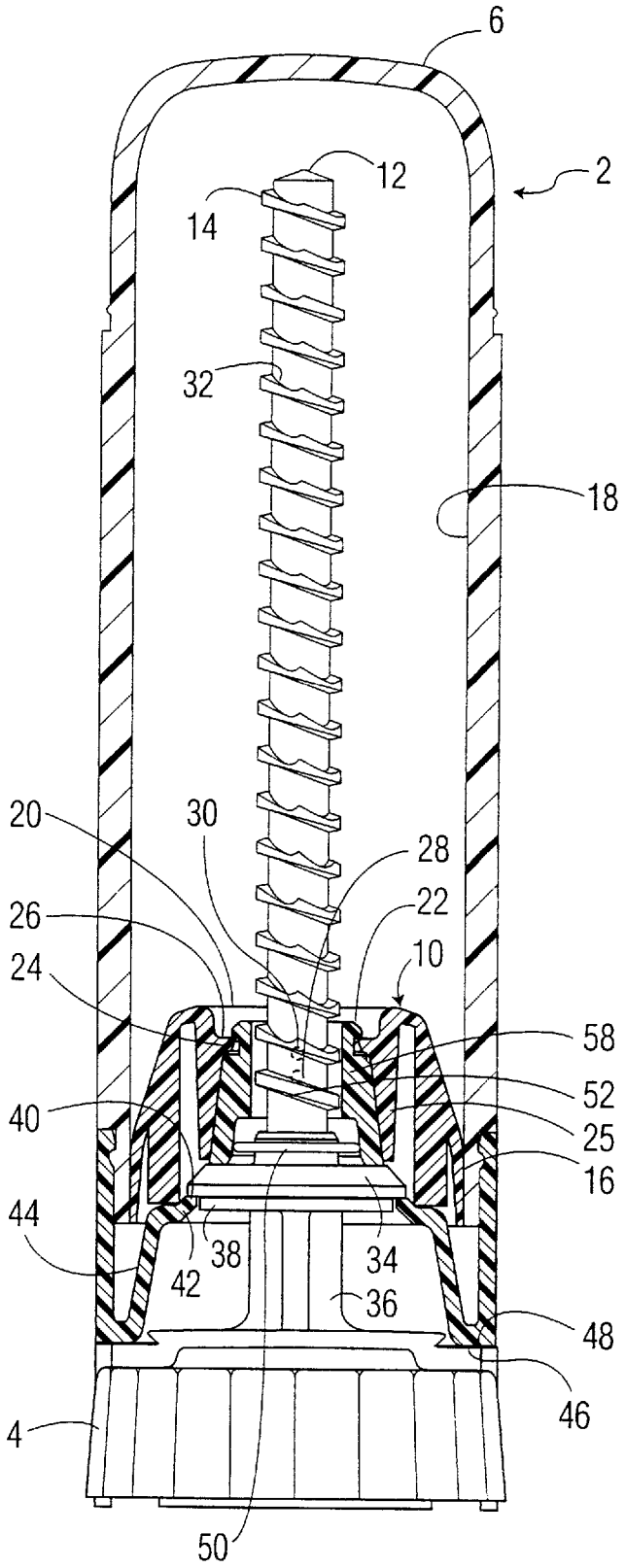
FIG. 2A is a cross-section 2, 2 of FIG. 1A in one embodiment of the invention.
FIG. 2B is an enlarged view of the lower portion of FIG. 2A.

In the cross-section 2, 2 of FIG. 1 that is shown in FIG. 2, it is seen that the outer periphery 16 of the elevator 10 is in contact with the inner wall 18 of the container 2, which, as shown in FIG. 1B, is other than circular in cross-section. The spindle 12 with the helical ramp 14 wrapped around it is coaxial with the container 2 so as to extend through the elevator 10, which in this embodiment of the invention, is comprised of a cup 20 and a collar 22. The cylindrical collar 22 has an external circumferential groove 24 that snaps onto a circumferential ridge 26 around the inside of the cup 20. Cup 20 also includes an inner circular flange 25. Diametrically opposed pins 28 and 30, not shown, that are axially displaced by the height of one-half turn of the helix 14 extend inwardly from the front and rear of the collar 22 so as to ride on diametrically opposed front and rear sides of the ramp 14. Thus, as the spindle 12 is axially rotated in one direction, the pins 28 and 30 ride up the ramp 14, carrying the collar 22 and the cup 20 that form the elevator 10 with them so as to force any cream within the container 2 that is between the elevator 10 and the dome 6 through the apertures 8 in the dome 6. As the pins 28 and 30 ride on the helical ramp 14 they follow the contours of specially shaped valleys 32 in the ramp 14. Note that the valleys each have a radius at their peaks as shown in enlarged views such as FIG. 5B. Also, although not shown in FIGS. 2, 2A, and 4, the peaks are generally not in vertical alignment with one another, but skewed relative to one another as described below with reference to FIGS. 5C and 6B.

The spindle 12 is mounted for axial rotation by affixing its bottom end to a hub 34 that is mounted for axial rotation on the inside of the container 2. The knob 4 is attached by a shaft 36 to the hub 34. Thus, turning the knob 4 in the proper direction causes the spindle 12 and the helical ramp 14 to rotate so as to advance the elevator 10 toward the dome 6.

In this particular embodiment of the invention, the hub 34 has a cylindrical axial extension 38 of smaller diameter on the side facing the knob 4 so as to form a circular shelf 40 that interfits with the inner end 42 of a reentrant tube 44 of the container 2 to provide a circular bearing. A bearing surface 46 of the knob 4 bears against a surface 48 at the end of the container 2. In assembly, the spindle 12 to which the collar 22 and the cup 20 have been attached is thrust along the axis of the container 2 until the shelf 40 of the hub 34 snaps over the inner end 42 of the reentrant tube 44, at which point the bearing surface 46 of the knob 4 will bear against the surface 48 of the container 2.

Cream within the container 2 is prevented from passing between its inner wall 18 and the outer periphery of the cup 20 of the elevator 10 because of the frictional contact between them, and it is prevented from passing between the elevator 10 and the collar 22 by the engagement of the ridge 26 and the groove 24.

In order to prevent separation products of the compound from escaping through the collar 22 along the helical ramp 14, a sealing bead 50 extending around the spindle 12 and adjacent to the hub 34 is in pressure contact with the inside of the collar 22.

Note that the collar 22 consists of a high density polyethylene (HDPE) material or other suitable high density resin material. The remainder of the container consists of polypropylene or other suitable material.

Figure 2A:
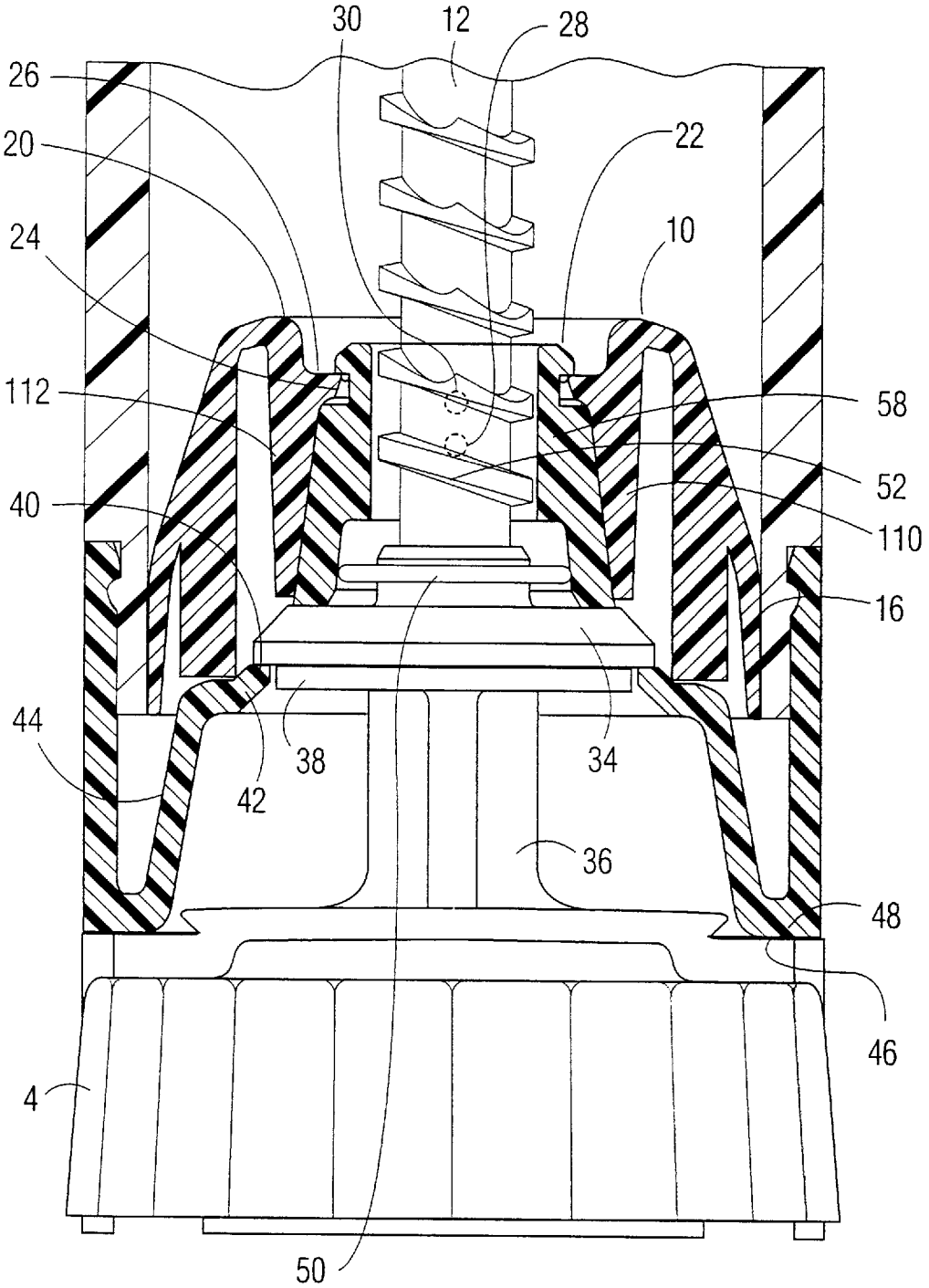
Figure 3A:
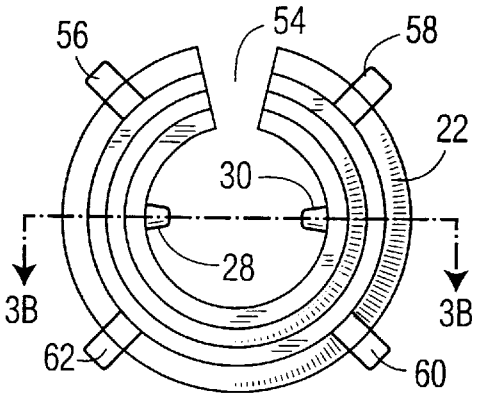
FIG. 3A is a top view of a collar.
Figure 3B:
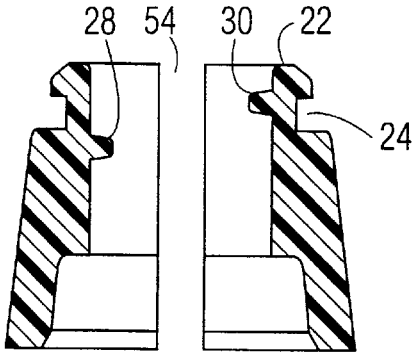
FIG. 3B is a cross-sectional view 3B, 3B of FIG. 3A collar.
Figure 3C:
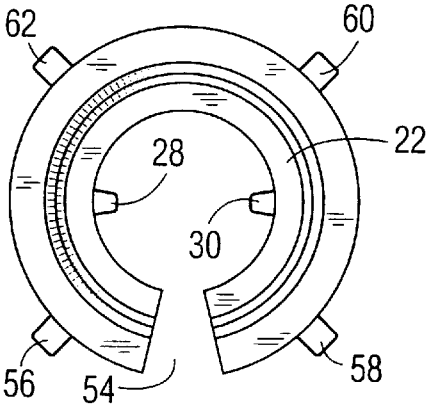
FIG. 3C is a bottom view of the collar of FIG. 3A.
Figure 3D:
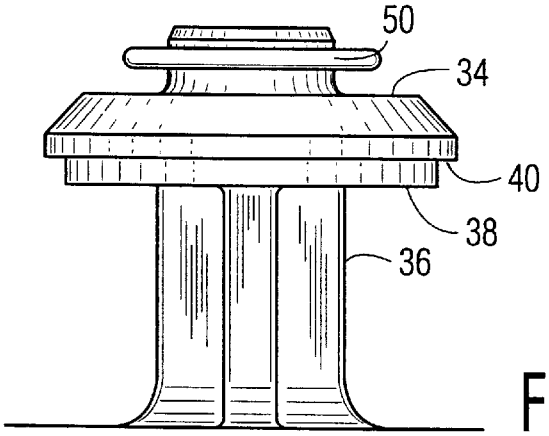
FIG. 3D is an external view of the base portion of a spindle carrying the helical ramp showing its seal.

Reference is made to FIGS. 3A, 3B, and 3C for a more detailed description of an embodiment of the collar 22. In the axial cross-section of FIG. 3A, the diametrically opposed pins 28 and 30 extend radially inward from the collar 22 and are axially displaced by one-half the elevation of a turn of the helical ramp 14. The annular groove 24 is adjacent the top of the collar 22. Before assembly, the collar 22 has a longitudinal gap 54 parallel to its axis, but when assembled as shown in FIGS. 2 and 2A, the gap 54 is closed so as to provide a continuous surface against which the sealing bead 50 bears. Extending downwardly and outwardly from the outside of the collar 22 are legs 56, 58, 60, and 62 that as seen in FIG. 2 rest on the hub 34. FIG. 3A is a top view of the collar 22, FIG. 3B is a section 3B, 3B thereof, FIG. 3C is a bottom view of the collar 22, and FIG. 3D is an external enlarged view of the hub 34 showing the projection 38 from the hub that with the hub form the circular shelf 40, the sealing bead 50 and the shaft 36 between the projection 38 and a knob that is not shown.

Figure 4:
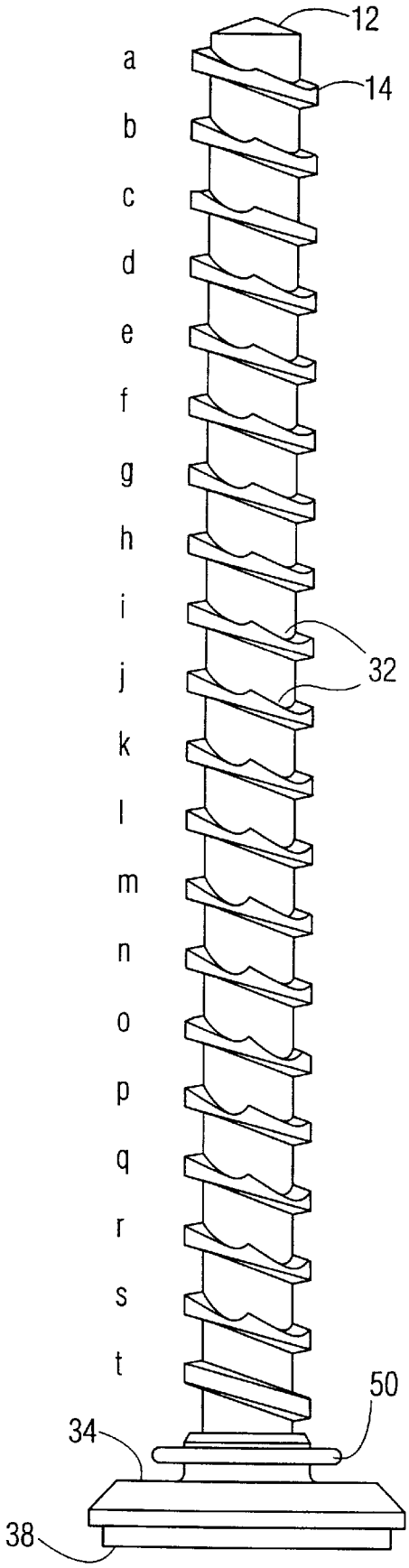
FIG. 4 illustrates a helical ramp mounted around a spindle.

In FIG. 4 the helical ramp 14 that winds around the spindle 12 is shown to have turns "a" through "t" of a low slope. Distributed along the ramp 14 are the valleys 32. The valleys 32 of turns "a" through "s" vary in length and depth to provide random pressure relief. Note that "t" is a starter thread (see FIG. 5C).

Figure 5A:
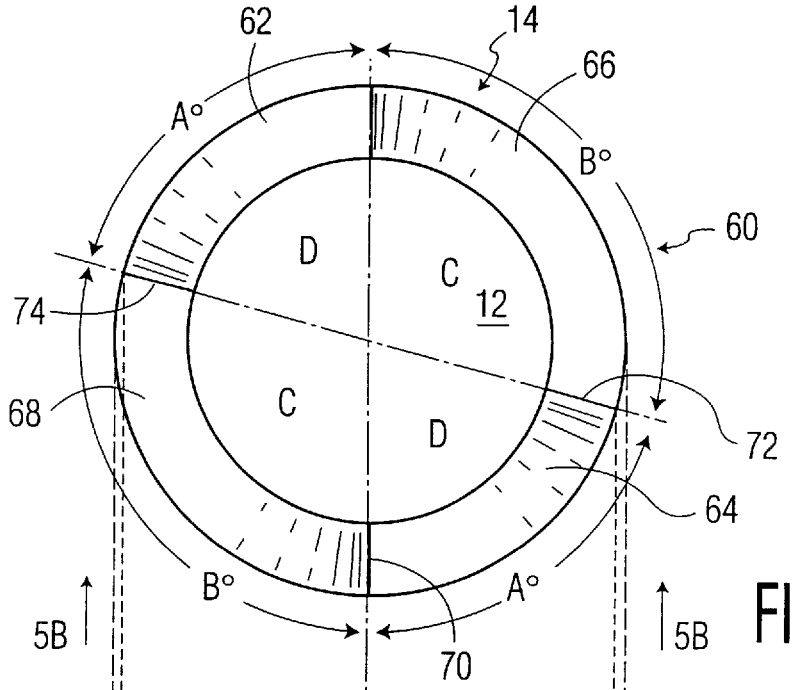
FIG. 5A is an axial view of one turn of an helical ramp.
Figure 5B:
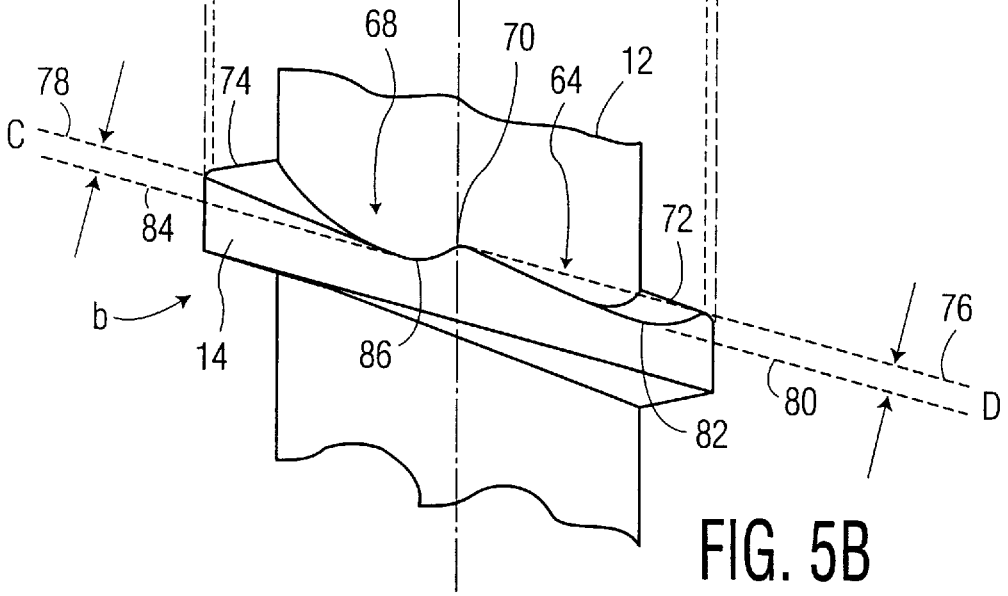
FIG. 5B is a side view of one-half of the turn shown in FIG. 5A.

In a single turn of the ramp 14 depicted in the axial view of the spindle 12 shown in FIG. 5A, each of a pair of diametrically opposed valleys 62 and 64 subtend and angle of A° around the spindle 12, and each of another pair of diametrically opposed valleys 66 and 68 subtend and angle of B°. FIG. 5B is a side view 5B, 5B of FIG. 5A in which only valleys 64 and 68 are visible. They meet at a peak 70. Although the valley 66 of FIG. 5A is not visible of FIG. 5B it meets the valley 64 at a peak 72. Similarly, the valley 62 meets the valley 68 at a peak 74.

The slope of the ramp 14 is illustrated by a dashed line drawn through the peaks 70 and 72 and a dashed line 78 drawn through the peaks 70 and 74. A dashed line 80 that is parallel to the dashed line 76 passes through the bottom 82 of the valley 64 so that the depth of the valley 64 is the distance D between the dashed lines 76 and 80. A dashed line 84 that is parallel through the dashed line 78 passes through the bottom 86 of the valley 68 so that the depth of the valley 68 is the distance C between the dashed lines 78 and 84.

Since diametrically opposed valleys of a single turn are identical, the valleys 62 and 64 are of the depth D and subtend angle of A° about the spindle 12, and the valleys 66 and 68 are of the depth C and subtend angle of B°. In each case, A°+B°=180°.

The table of FIG. 5C illustrates one example of the lengths and depths of the valleys in the turns "a" through "s" of the ramp 14. If A=75°, B=105°, C=0.013" and D=0.012", FIGS. 5A and 5B show the turn "b". As indicated, thread "t" is a starter thread.

Figure 6A:
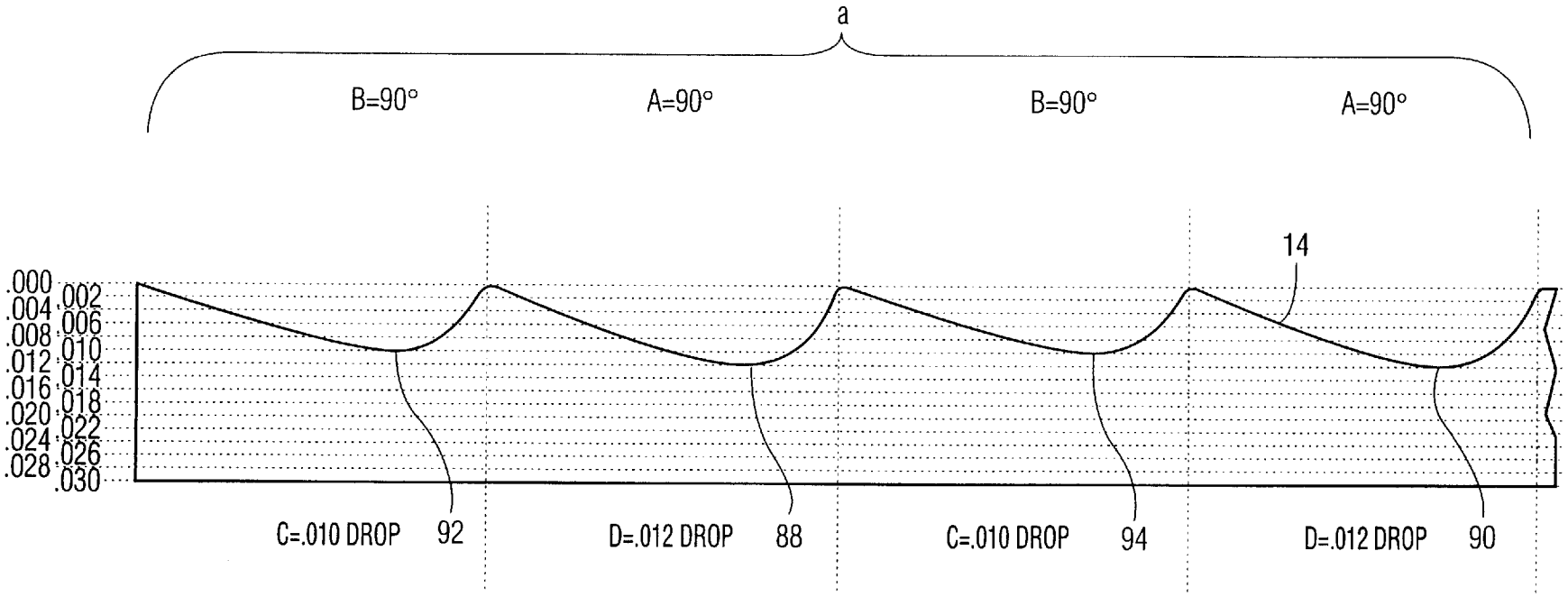
FIG. 6A illustrates the "a" turn of the ramp of FIG. 5C formed into a straight line.

FIG. 6A shows what the turn "a" of FIG. 5C would look like if it were straightened out. The dimensions on the left are measurements from the top of the ramp 14. Identical valleys 88 and 90 that would be on opposite sides of the spindle 12 subtend an angle "A" of 90° and have a depth of 0.012". Although not shown in this drawing, the valleys 88 and 90 are axially displaced with respect to each other by one-half the height of one turn. Identical valleys 92 and 94 that would be on opposite sides of the spindle 12, subtend an angle "B" of 90° and have a depth of 0.010".

Figure 6B:
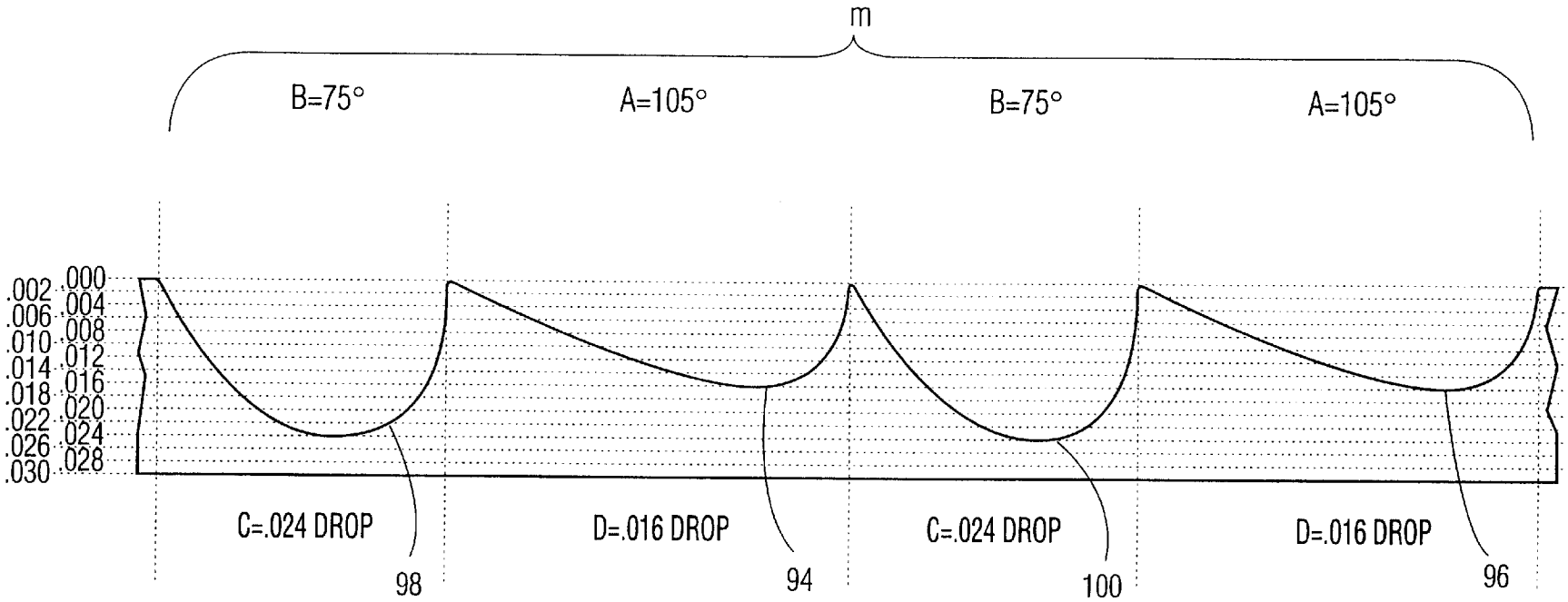
FIG. 6B illustrates the "a" turn of a ramp of FIG. 5C formed into a straight line.

FIG. 6B shows what the turn "m" in the table of FIG. 5C would look like if it were straightened out. The dimensions of depth are shown by the horizontal dashed lines. Valleys 94 and 96 would be on opposite sides of the spindle 12, and although not shown they are axially displaced with respect to each other by one-half the height of one turn. The valleys 94 and 96 are necessarily identical with their subtended angles being A=105° and their depth below the ramp being 0.016". The other pair of valleys 98 and 100 of the turn "m" are also identical and axially spaced by one-half the axial height of one turn, but the subtended angles are B=75°, and their depths are 0.024".

Figure 7:
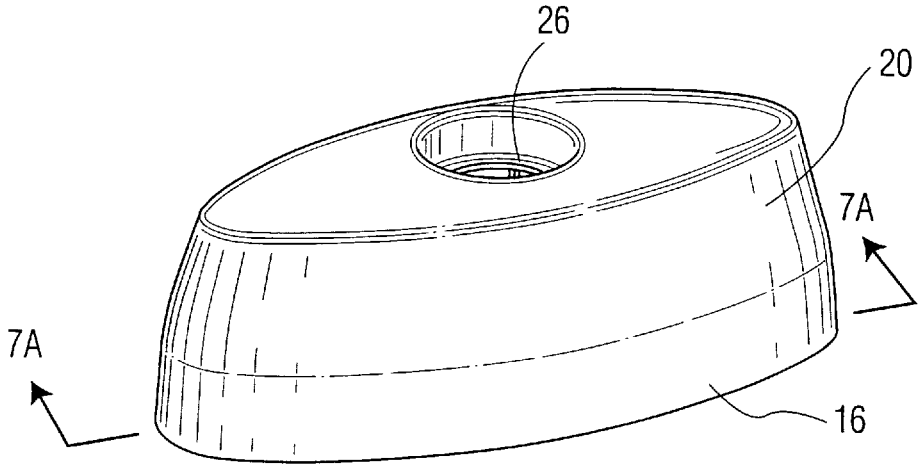
FIG. 7 is an outside projection view of the top of an elevator.
Figure 7A:
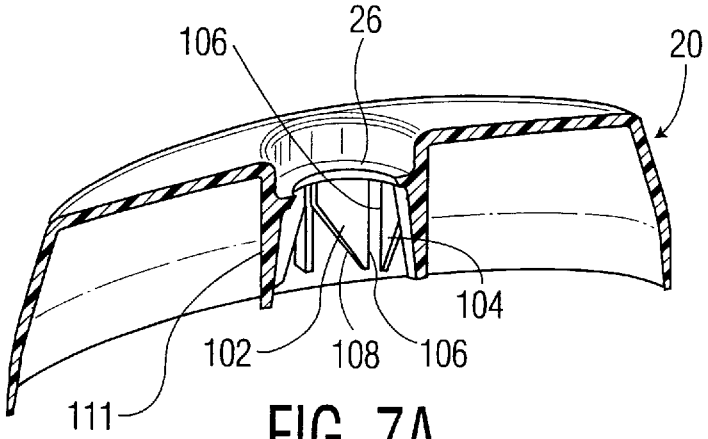
FIG. 7A is a section 7A, 7A of FIG. 7.
Figure 7B:
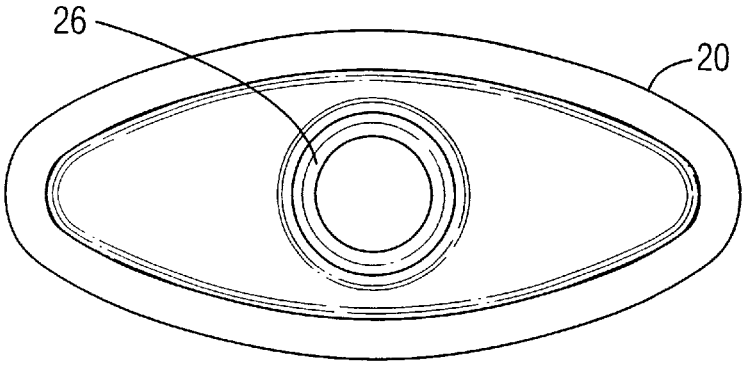
FIG. 7B is a top view of the elevator of FIG. 7.
Figure 7C:
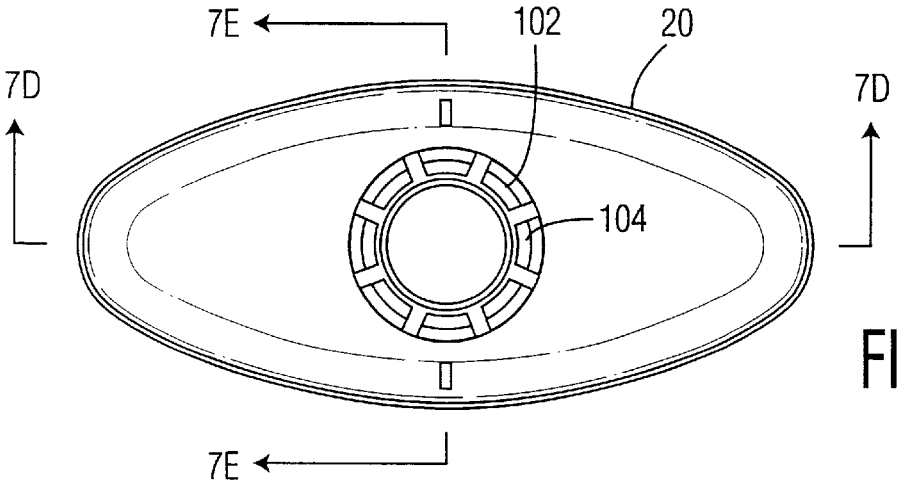
FIG. 7C is a bottom view of the elevator of FIG. 7.
Figure 7D:
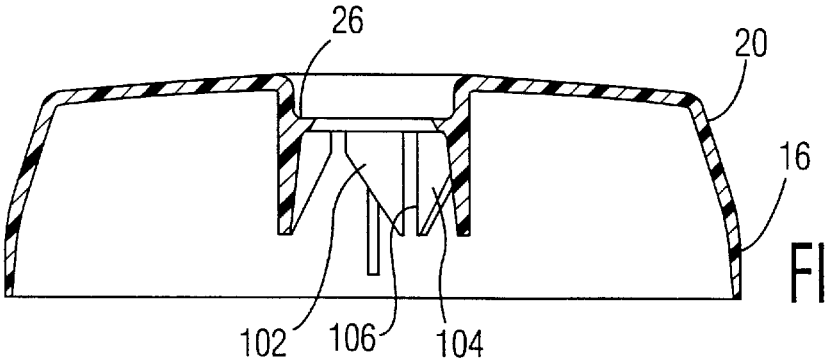
FIG. 7D is a section 7D, 7D of FIG. 7C.
Figure 7E:
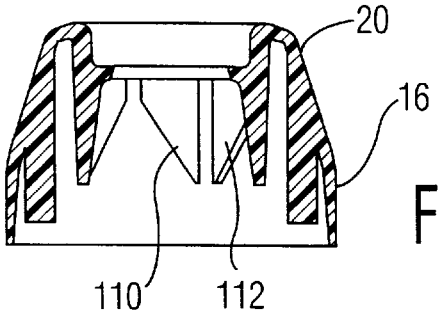
FIG. 7E is a section of 7E, 7E of FIG. 7C.

FIG. 7 is an external view of the cup 20 by itself showing the ridge 26 that is to snap into the circumferential groove 24 of the collar 22 (see FIGS. 3A, 3B, and 3C). In the cross-section 7A of FIG. 7, pairs of fingers such as 102 and 104 extend downwardly from around the ridge 26, with the fingers 102 and 104 having vertical edges 106 spaced slightly from each other and tapered bottoms 108. In Fingers 2 and 2A the cross-section of such fingers appear at 110 and 112. FIG. 7B is a top view of the cup 20, and FIG. 7C is a bottom view, in which only the fingers 104 are identified by number. The fingers are flexible and forced outwardly by the collar 22 so as to stabilize the structure of the elevator 10 (see FIG. 2A). FIG. 7D is a section of FIG. 7C, and FIG. 7E is a section of 7C, showing fingers 110 and 112. Note that the outer periphery 16 of the elevator 10 (see FIG. 2A), which is the outer periphery of the cup 20, is farther from the center in FIG. 7D than in FIG. 7E because of the oval shape of the cup 20.

Figure 8A:
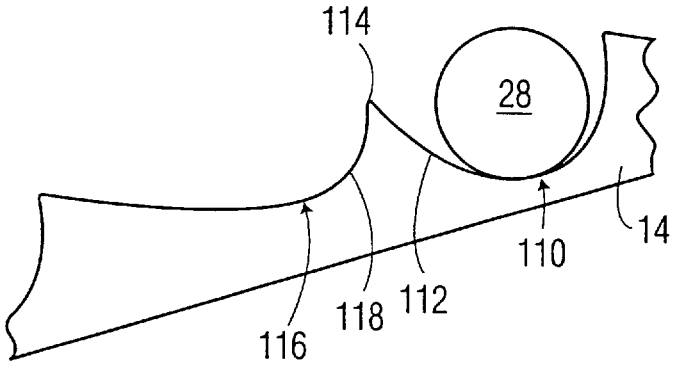
FIGS. 8A, 8B, 8C, and 8D illustrate the progression of a pin through the valleys of an helical ramp.
Figure 8B:
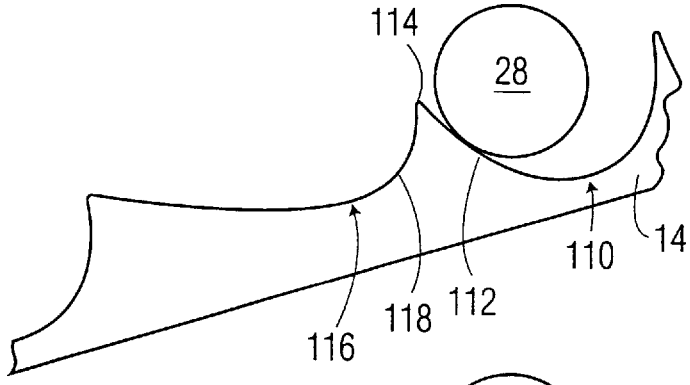
Figure 8C:
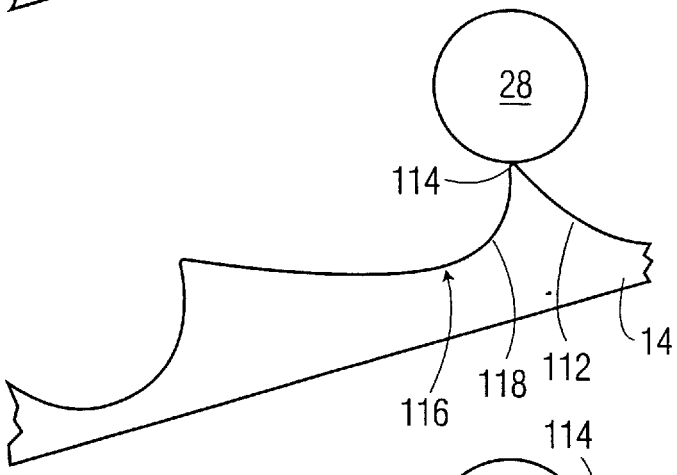

Operation of the applicator of this invention will now be described by reference to FIGS. 8A, 8B, 8C, and 8D showing different positions of a pin, such as the pin 28, as the spindle 12 is rotated. In FIG. 8A, the pin 28 is resting at the bottom of a valley 110, but as the spindle 12 is rotated, the pin 28 rides up the up ramp side 112 of the valley 110 so as to force the elevator mechanism 10 upwardly toward the dome 6 and force the substance between the elevator 10 and the dome 6 through the apertures 8.

Figure 8D:
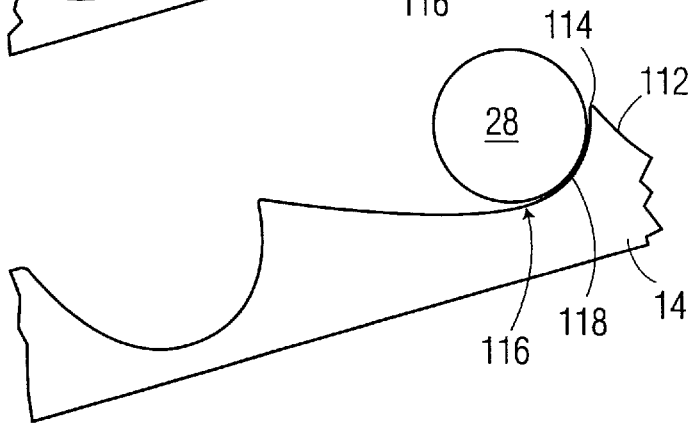

The maximum movement of the elevator 10 during this portion of the operation occurs when the pin 28 is on top of a ridge between the valley 110 and the next valley 116 along the ramp 114. When the ramp 14 is rotated a little bit more, the pin 28 is forced down the down ramp portion 118 of the valley 116 as shown in FIG. 8D by the pressure in substance being distributed so as to relieve that pressure and prevent the substance from weeping out of the apertures 8. It is important that the down ramp sides of a valley be steeper than the up ramp sides.

Figure 9:
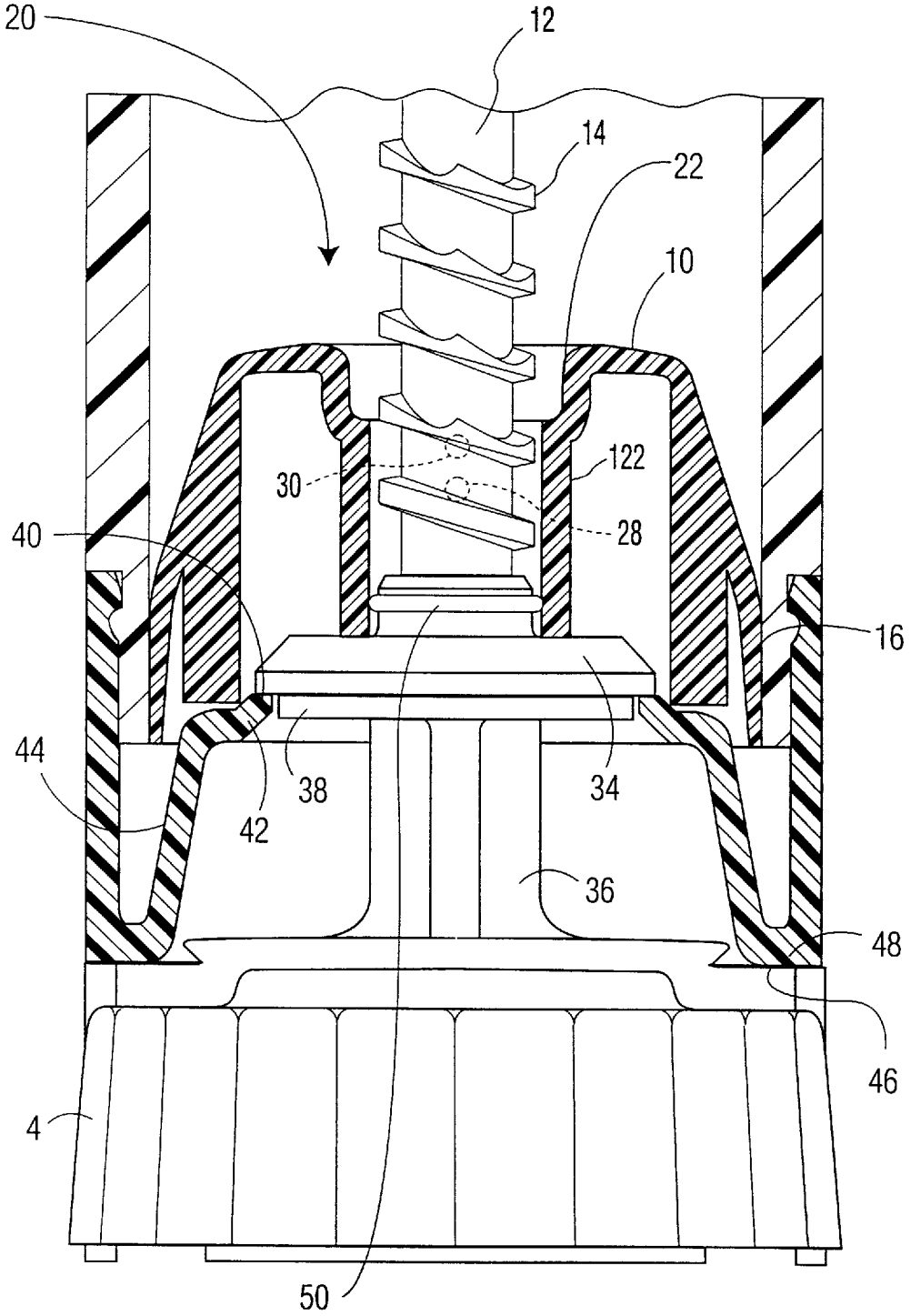
FIG. 9 is an axial cross-section through an elevator having a unitary structure.

Reference is made to the axial cross-section of FIG. 9 for a description of an applicator having an elevator 10 of unitary construction so as to eliminate the collar 22. A cup 120 is provided having the same outer shape as the cup 20 of FIGS. 2 and 2A, but a cylindrical section 122 is formed at the center with such inner diameter as to form a seal with the sealing bead 50. Thus the section 122 takes the place of fingers like 102 and 104 in FIG. 2 and 2A and rests on the top of the hub 34. Pins extend radically inward from the front and back of the cylindrical section 122 at position such as indicated at 28 and 30 and rides on the ramp 14.

Figure 9A:
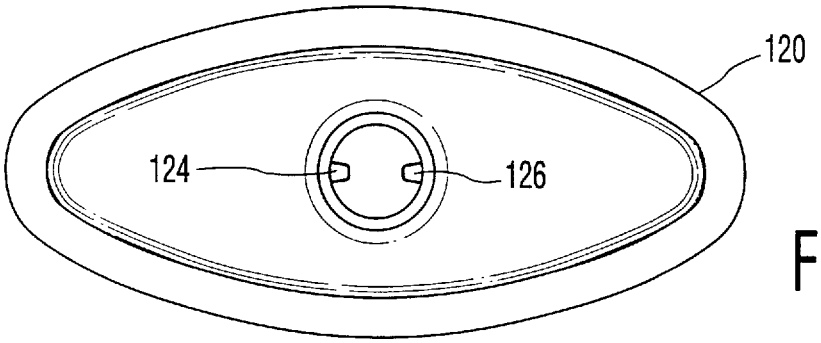
FIG. 9A is a top view of the elevator of FIG. 9.
Figure 9B:
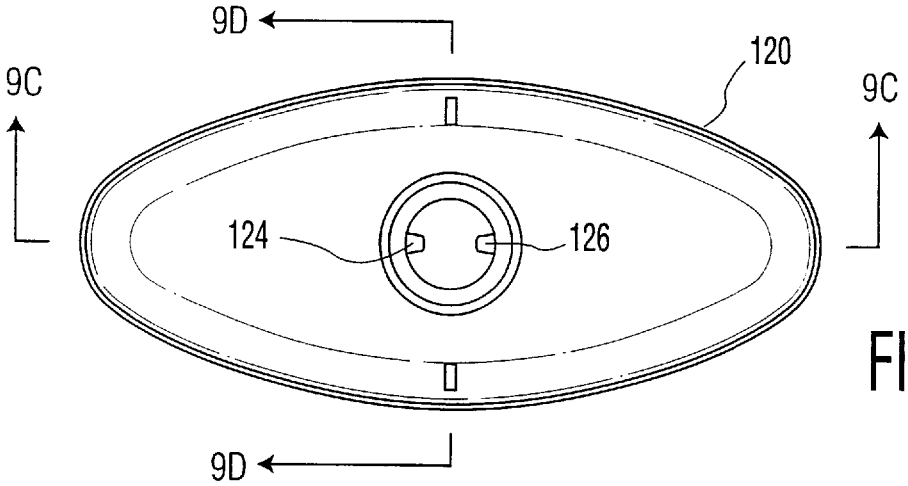
FIG. 9B is a bottom view of the elevator of FIG. 9.
Figure 9C:
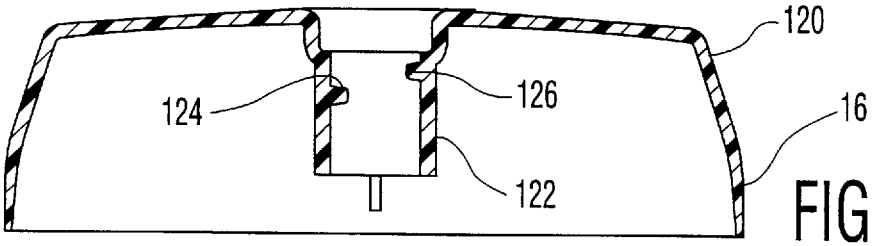
FIG. 9C is a section 9C, 9C of FIG. 9B.
Figure 9D:
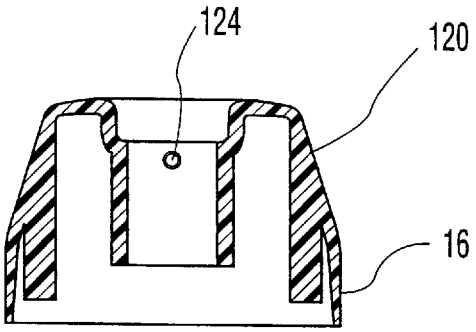
FIG. 9D is a section 9D, 9D of FIG. 9B.

FIG. 9A is a top view of the cup 120 showing pins 124 and 126, and FIG. 9B is a bottom view. FIG. 9C is a cross-section of 9C, 9C of FIG. 9B showing the axial displacement between the pins 124 and 126, and FIG. 9D is a cross-section of 9D, 9D of FIG. 9B.

Although various embodiments of the invention have been shown and described in detail, they are not meant to be limiting. Those of skill in the art may recognize certain modifications to these embodiments, which modifications are meant to covered by the spirit and scope of the appended claims.

What is claimed is:

1. An applicator comprising:

an elongated chamber having inner wall that is other than circular extending around a longitudinal axis;

a dome for one end of said chamber;

means defining apertures in said dome;

an elevator within said chamber having an outer periphery in frictional contact with said inner wall of said chamber;

a helical ramp that is coaxial with said elongated chamber;

ramp following means attached to said elevator riding on said helical ramp;

valleys in said ramp having an up ramp side, a down ramp side, and a bottom where said sides meet;

means for turning said ramp so as to cause said ramp following means to ride up said ramp and advance the elevator toward said dome; and the down ramp sides of said valleys being sufficiently steep to permit the pressure in a cream-like or gel-like compound between the elevator and the dome to force the ramp following means into the bottom of the next valley up the ramp so as to retract said elevator from said dome and relieve pressure on the compound.

2. An applicator as set forth in claim 1, wherein the depth of adjacent valleys have different depths, whereby the relationship between the amount of cream-like or gel-like compound dispensed and the distance that the elevator is retracted varies.

3. An applicator as set forth in claim 1, wherein said valleys are identical.

4. An applicator as set for in claim 1, wherein:

said ramp following means is comprised of a pair of diametrically opposed pins that are displaced along the axis of the helical ramp by a distance equal to one-half the height of one turn of the ramp; and the valleys on opposite sides of the ramp being identical.

5. And applicator as set forth in claim 4 further comprising:

a collar mounted within said elevator in sealed relationship herewith;

the axis of the collar coinciding with said longitudinal axis; and said pins extending readily inward from said collar.

6. An applicator as set forth in claim 5 wherein:

said helical ramp is mounted around a spindle having an extension beyond said ramp that extends through and beyond said collar and has an axis; and a seal formed between said extension of said spindle and said collar.

7. An applicator as set forth in claim 6 further comprising:

bearing means attached to the extension of said spindle for mounting said spindle for axial rotation about its axis within said chamber.

8. An applicator as set forth in claim 7 further comprising:

a knob attached to said spindle at a point on the opposite side of said bearing means as said helical ramp.

9. An applicator for a product in the form of a cream-like or gel-like compound comprising:

an elongated container having a chamber therein of uniform cross-section that is other than a circle, said chamber having an axis;

a dome having apertures therein at one end of said chamber;

an elevator having an outer periphery in friction contact with said chamber;

means defining an opening in said elevator through which the axis of said chamber passes;

a collar attached within said means defining an opening in said elevator;

diametrically opposed pins mounted on said collar that extends toward the axis of said chamber;

a cylindrical spindle having an axis;

a helical ramp having a plurality of turns mounted around said spindle;

means for mounting said spindle for coaxial rotation and coaxial with said chamber such that said helical ramp is within said chamber;

said pins being axially displaced by one-half the axial dimension of one turn of said helical ramp, whereby said pins are in contact with opposite sides of said ramp; and valleys in said ramp that allow pressure in said cream after a desired amount of cream-like or gel-like compound has been dispensed through said apertures to force said elevator away from said dome thereby relieving said pressure so as to prevent the cream from weeping through said apertures.

10. An applicator for a product in the form of a cream-like or gel-like compound comprising:

an elongated container having a chamber therein of uniform cross-section that is other than a circle, said chamber having an axis;

a dome having apertures therein at one end of said chamber;

an elevator having an outer periphery in friction contact with said chamber;

means defining an opening in said elevator through which the axis of said chamber passes;

diametrically opposed pins extending inwardly within said opening in said elevator;

a cylindrical spindle having an axis;

a helical ramp having a plurality of turns mounted around said spindle;

means for mounting said spindle for coaxial rotation and coaxial with said chamber such that said helical ramp is within said chamber;

said pins being axially displaced by one-half the axial dimension of one turn of said helical ramp, whereby said pins are in contact with opposite sides of said ramp; and valleys in said ramp that allow pressure in said cream-like or gel-like compound after a desired amount thereof has been dispensed through said apertures to force said elevator away from said dome thereby relieving said pressure so as to prevent the cream-like or gel-like compound from weeping through said apertures.

* * * * *